US007862729B2

(12) United States Patent
Stetson

(10) Patent No.: US 7,862,729 B2
(45) Date of Patent: Jan. 4, 2011

(54) DECK DRAIN COVER

(75) Inventor: Michael A. Stetson, Lake Elsinore, CA (US)

(73) Assignee: Stetson Development, Inc., Lake Elsinore, CA (US)

( * ) Notice: Subject to any disclaimer, the term of this patent is extended or adjusted under 35 U.S.C. 154(b) by 914 days.

(21) Appl. No.: 11/800,389

(22) Filed: May 4, 2007

(65) Prior Publication Data

US 2008/0272038 A1 Nov. 6, 2008

(51) Int. Cl.
*E03F 5/06* (2006.01)

(52) U.S. Cl. ..... 210/767; 210/164; 404/25; 52/20

(58) Field of Classification Search ..... None
See application file for complete search history.

(56) References Cited

U.S. PATENT DOCUMENTS 3,048,911 A * 8/1962 Almon ..... 16/2.1
4,015,373 A 4/1977 Boissier
4,456,397 A 6/1984 Freis et al.
4,462,123 A * 7/1984 Morris et al. ..... 4/286
4,499,695 A 2/1985 Oger et al.
4,649,674 A * 3/1987 Gaul et al. ..... 52/20
4,883,590 A * 11/1989 Papp ..... 210/164
4,919,564 A 4/1990 Neathery et al.
5,123,776 A * 6/1992 Lang et al. ..... 404/25
5,205,668 A 4/1993 Adams
5,209,601 A 5/1993 Odill et al.
5,240,346 A 8/1993 Yin et al.
5,362,174 A 11/1994 Yang
5,549,411 A 8/1996 Hawkins
5,564,855 A 10/1996 Anderson
5,711,536 A * 1/1998 Meyers ..... 277/606
5,769,564 A 6/1998 Hawkins
5,827,007 A 10/1998 Barton et al.
5,899,024 A 5/1999 Stannard
5,951,200 A 9/1999 Barton
5,996,612 A 12/1999 Crawford
5,997,212 A 12/1999 Takada et al.
6,035,581 A 3/2000 McCoy
6,393,771 B1 5/2002 Stetson
6,799,606 B1 * 10/2004 Howson ..... 138/96 R
7,223,051 B1 * 5/2007 Vought et al. ..... 405/184.1
7,361,834 B1 * 4/2008 Trangsrud et al. ..... 174/66
7,451,570 B1 * 11/2008 Gavin ..... 52/20
7,574,831 B2 * 8/2009 Meyers ..... 52/21
7,627,992 B1 * 12/2009 Gavin ..... 52/20
7,695,213 B1 * 4/2010 Akkala et al. ..... 404/25
2002/0166291 A1 * 11/2002 Campbell et al. ..... 52/20
2003/0145527 A1 * 8/2003 Meyers ..... 52/20
2008/0044225 A1 * 2/2008 Swartz ..... 404/25
2008/0189926 A1 * 8/2008 Luxton ..... 29/428

(Continued)

*Primary Examiner*—Robert James Popovics
(74) *Attorney, Agent, or Firm*—Stetina Brunda Garred & Brucker

(57) ABSTRACT

There is provided a drain cover for a drain disposed within a fabricated layer having an exposed surface. The drain includes a frame member having a top surface. The frame member extends through the fabricated layer. The drain cover includes a collar having a lower surface that is placed adjacent to the top surface of the frame member. The drain cover also includes a cup member having a cavity operative to receive a filling material. The collar defines an area within the exposed surface that is larger than the area of the cup member. There is at least one fin connected to the collar and the cup member.

17 Claims, 2 Drawing Sheets

U.S. PATENT DOCUMENTS

2008/0260460 A1* 10/2008 Nolle et al. ..... 404/25
2008/0272038 A1* 11/2008 Stetson ..... 210/164
2009/0180832 A1* 7/2009 Vrondran et al. ..... 404/25

* cited by examiner

DECK DRAIN COVER

CROSS-REFERENCE TO RELATED APPLICATIONS

Not Applicable.

STATEMENT RE: FEDERALLY SPONSORED RESEARCH/DEVELOPMENT

Not Applicable

BACKGROUND

This invention relates in general to drain covers. In particular, the present invention relates to drain covers located within a fabricated layer having an exposed surface and a method of constructing the drain cover within the fabricated layer.

Many residential and commercial buildings include decorative or landscaped surfaces, such as decks, patios, porches, garages, etc. Such surfaces are commonly located outside and exposed to precipitous elements, or located adjacent to a pool, sprinkler, or water feature. Consequently, water and other liquids may accumulate on the surface. Water makes the surface very slick, and may cause unsafe conditions. Furthermore, if the water is not removed from the surface, the water may cause aesthetic or structural damage. Therefore, many surfaces are oftentimes graded to induce the liquid to runoff in a predisposed direction. In some cases, the liquid runoff is directed toward a runoff area, which may include vegetation or soil located adjacent to at least one side of the landscaped surface. However, in other cases, the particular landscaped surface is situated such that an appropriate runoff area is not available. For example, the surface may be surrounded by four walls, i.e. a courtyard, or the surface may extend between a house and a pool. In either case, the landscaped surface cannot be graded to direct the water to an appropriate runoff area. Therefore, many surfaces include a drain which collects the water that accumulates on the surface.

Most drains include plumbing that directs the water into a drainage system. The drain includes a lid on top of the plumbing. In most cases, the lid is flush with the landscaped surface. The cover or lids for current drains are typically not constructed from the same material as the surrounding landscaped surface. The landscaped surfaces are commonly constructed out of concrete, asphalt, exposed aggregate, stone, brick, epoxy and/or other landscaping materials, whereas the drain cover is commonly constructed out of metal, typically brass. This difference in material has several functional and cosmetic disadvantages. In particular, drain covers constructed from dissimilar materials can be a safety hazard because the cover will generally have a different coefficient of friction compared to the surrounding landscaped surface. For example, most metal drain covers typically include a relatively smooth finish, whereas the landscaped surface oftentimes includes a slip-resistant finish. A significant change in surface texture such as this increases the risk of a slip and fall accident as unsuspecting persons step from one surface having a high coefficient of friction to another having a lower coefficient of friction or visa-versa. Moreover, the risk of an accident can be especially great when the cover is wet, as may be the case when children are playing near a swimming pool.

In addition to creating a potential safety hazard, drain covers constructed from dissimilar materials can also be less desirable for cosmetic reasons. In many cases, a large amount of time and money is spent to make the landscaped surface look as aesthetically pleasing as possible. Many of the surfaces are intended to be prominent architectural features. In this setting, it may be more desirable to use a drain cover which matches the visual appearance of the surrounding fabricated layer.

Therefore, there is a need in the art for a more aesthetically appealing drain cover for a drain that is located within a landscaped surface.

BRIEF SUMMARY

According to an aspect of the present invention, there is provided a drain cover for a drain located within a fabricated layer having an exposed surface. The drain includes a frame member comprising a top surface at the drain opening. The frame member extends through the fabricated layer and connects with the drainage system. The drain cover includes a collar having a lower surface. The drain cover is placed over the drain opening such that the lower surface of the collar is placed adjacent to the top surface of the frame member. The collar additionally comprises an upper surface that is preferably substantially flush with the exposed surface of the fabricated layer. However, it is understood that the top surface may be recessed below or protrude slightly above the exposed surface of the fabricated layer. The drain cover additionally includes a cup member having a cavity operative to receive a filling material. The filling material is placed within the cavity such that the filling material is preferably substantially flush with the top of the cavity wall. The filling material may be comprised of the same material used to construct the fabricated layer; however, it is understood that alternate materials may also be used. The drain cover further includes at least one fin connected to the collar and the cup member. The collar defines an area within the exposed surface that is larger than the area of the cup member.

The present invention additionally includes a methodology of constructing a drain cover within the fabricated layer. It is contemplated that the drain cover may be constructed within a fabricated layer as the fabricated layer is being formed. In addition, the drain cover may be retrofitted into an already existing drain within an already existing fabricated layer. The methodology of constructing a drain cover within a fabricated layer as the fabricated layer is being formed includes providing the drain cover as described above. The drain cover is positioned over the drain opening such that the fabricated layer is constructable around the drain cover. The fabricated layer is subsequently constructed around the drain cover such that the upper surface of the collar is substantially flush with the exposed surface of the fabricated layer. The filling material may then be inserted within the cup member cavity. The filling material is preferably comprised of the same material comprising the fabricated layer. The filling material may be leveled with the cup member cavity such that the filling material is disposed in a substantially level and flush position with the fabricated layer.

When the drain cover is retrofitted into an existing fabricated layer, the existing drain cover must be removed from the existing drain. Then the drain cover of the present invention is placed within the drain. The filling material may then be inserted within the cavity.

The present invention allows a user to construct the drain cover from materials that enhance the visual appearance of the cover. In addition, the cover provides great flexibility in the choice of materials and thereby facilitates custom fabrication to better match the requirements of a particular installation. The drain cover of the present invention may also be safer than many existing drain covers because the coefficient of friction of the filling material may be more similar to the coefficient of friction of the fabrication than the coefficient of friction of the metal drain covers.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Drains are disposed within a number of different surfaces, including garages, patios, porches, pool decks, yachts, etc. Many drains include a cover to screen-out larger particles from entering the drainage system. Typically, such drain covers are constructed from metal, whereas the surrounding surface may be constructed from another material, such as asphalt or cement. A drain cover that is constructed from a material that differs from the surrounding surface may be an eyesore, as well as unsafe.

Figure 1:
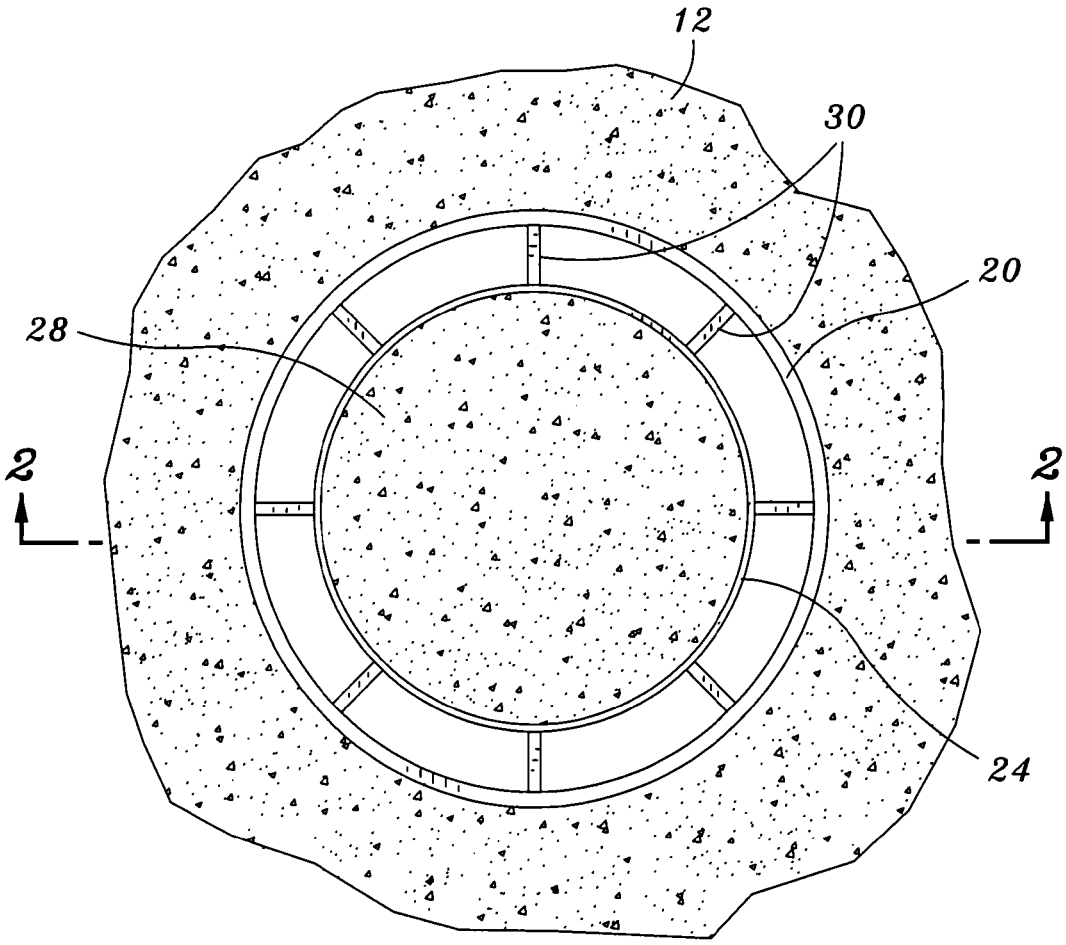
FIG. 1 is a top elevation view of a drain cover constructed in accordance with the present invention, wherein the drain cover is disposed within a fabricated layer.
Figure 2:
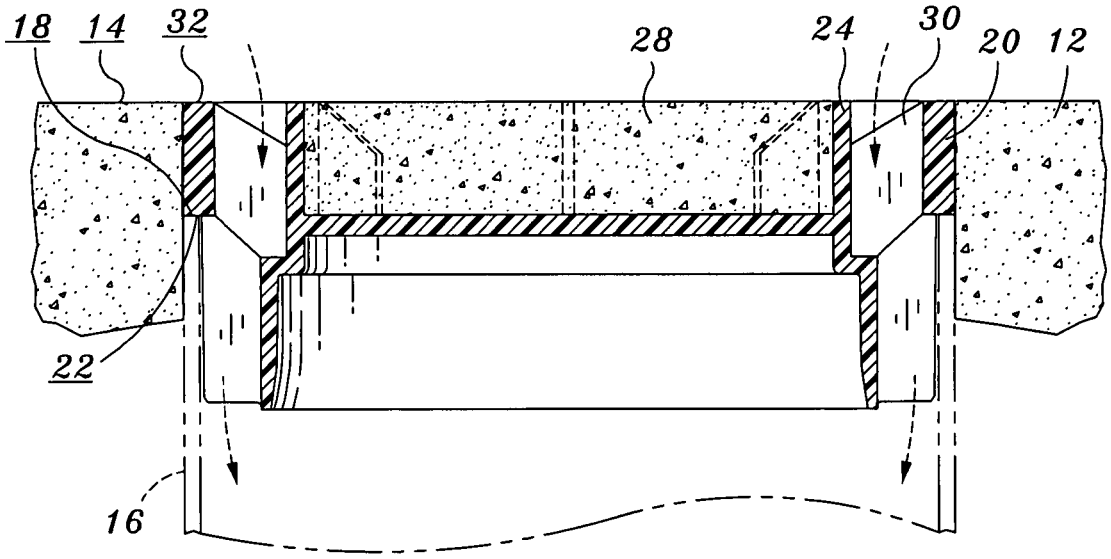
FIG. 2 is a cross-sectional view taken along line 2-2 of FIG. 1.
Figure 3:
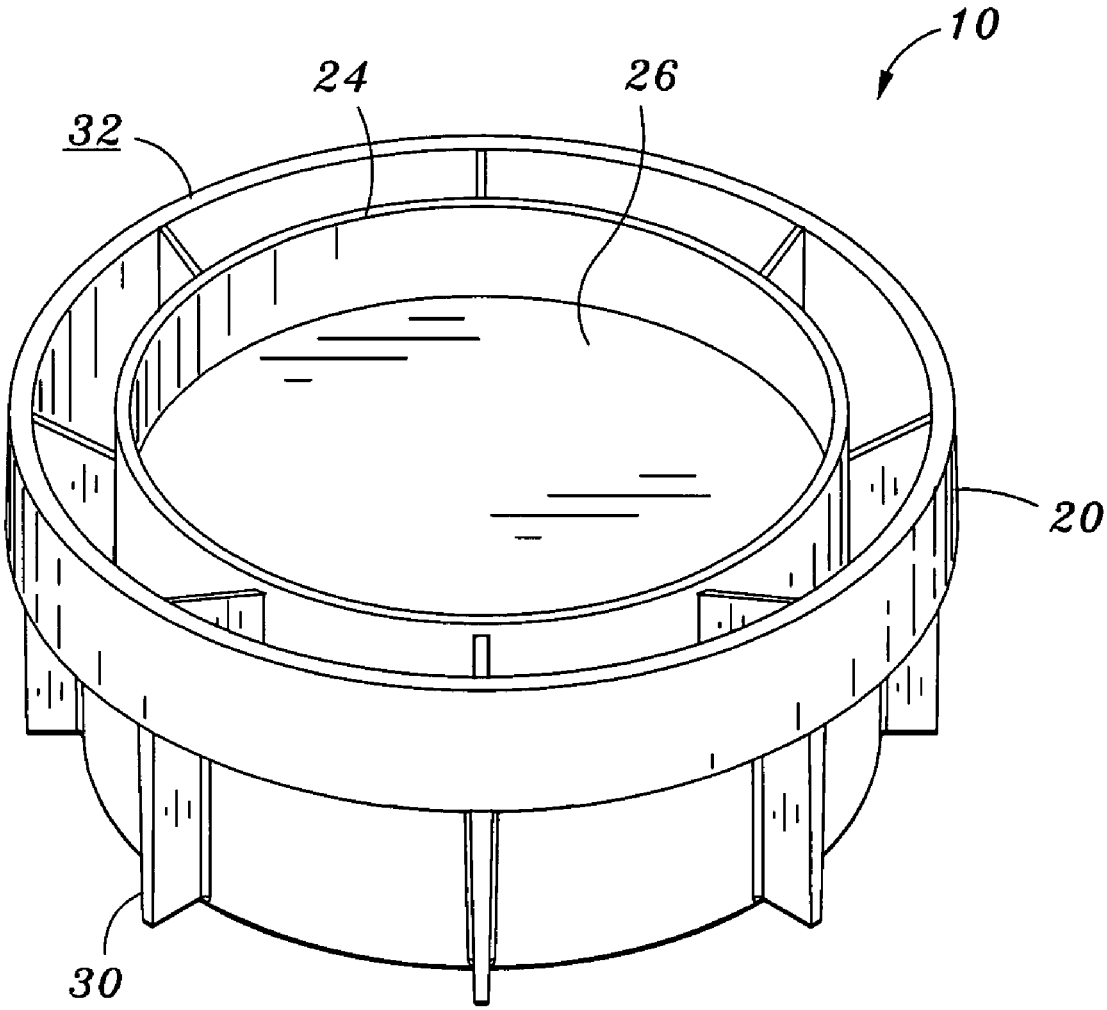
FIG. 3 is a top perspective view of the drain cover.

Referring to FIGS. 1-3 and according to an aspect of the present invention, there is provided a drain cover 10 for a drain located within a fabricated layer 12 having an exposed surface 14. The fabricated layer 12 may be constructed of any commonly used landscaping material, including but not limited to asphalt, ceramic, aggregate, concrete, brick, stone, wood or similar material. The fabricated layer 12 may comprise the surface of a garage, patio, porch, deck, etc. The fabricated layer 12 includes a surface that is graded to induce liquid accumulated thereon to flow toward the drain. The drain cover 10 is disposed within the fabricated layer 12. The drain includes a frame member 16 that extends through the fabricated layer 12. The frame member 16 includes a top surface 18 at the drain opening. It is contemplated that the frame member 16 may be comprised of the end portion of a drain pipe, or it could be a separate piece of piping that is connected with the remainder of the drainage system. Preferably, the frame member 16 is constructed of polyvinyl chloride (PVC), Acrylonitrile Butadiene Styrene (ABS), or other materials known by those skilled in the art.

In one embodiment of the invention, the drain cover 10 includes a collar 20. The collar 20 comprises a lower surface 22 which is placed adjacent to the top surface 18 of the frame member 16, as shown in FIG. 2. The collar 20 also includes an upper surface 32, which is preferably substantially flush with the exposed surface 14 of the fabricated layer 12. When the upper surface 32 is substantially flush with the exposed surface 14, the uniformity of the exposed surface 14 is maintained, thereby creating a safe and aesthetically pleasing drain cover 10. Although it is preferable that the upper surface 32 is substantially flush with the exposed layer 14, it is understood that certain implementations of the present invention may include a collar 20 that is not flush with the exposed layer 14. For instance, the upper surface 32 may be recessed below the plane of the exposed surface 14 of the fabricated layer 12.

According to one embodiment, the collar 20 is detachably connected to the frame member 16. In this regard, the collar 20 may be removed to access the frame member 16, as well as the drainage system. This may be particularly beneficial when the drainage system becomes blocked. The collar 20 may be quickly and easily detached from the frame member 16 to provide access to the debris blocking the system. In another embodiment, the collar 20 may be permanently connected to the frame member 16. In addition to the frame member 16, the collar 20 may also be constructed of PVC, ABS, or other materials known by those skilled in the art.

The drain cover 10 further comprises a cup member 24 that includes a cavity 26 operative to receive a filling material 28. Preferably, the cup member 24 is flush with the exposed surface 14 of the fabricated layer 12 to maintain the uniformity of the exposed surface 14. However, it is understood that the cup member 24 may be recessed below or elevated above the plane of the exposed surface 14. The filling material 28 is placed within the cavity 26 of the cup member 24. In the preferred embodiment, the filling material 28 is comprised of the same material used to form the fabricated layer 12. In this regard, the filling material 28 provides aesthetic uniformity between the drain cover 10 and the fabricated layer 12. This creates a more visually pleasing relationship between the drain cover 10 and the fabricated layer 12. It also provides a safer surface because the coefficient of friction of the filling material 28 is the same as the coefficient of friction of the fabricated layer 12. Therefore, the present invention mitigates the likelihood of a slip and fall accident compared to the likelihood of a slip and fall accident on a surface employing a metal drain cover.

Other embodiments of the present invention may include a filling material 28 comprised of a material different than the fabricated layer 12 material. For instance, the exposed surface 14 may be comprised of brick. Although brick may be cut and placed within the cavity 26, it may be easier to fill the cavity with a castable material. In this regard, the filling material 28 may be cast within the cavity 26 and given time to cure. Although the castable material is different than the brick, it may complement the brick. For example, if the brick is red, a red castable material may be used.

It is contemplated in one embodiment of the present invention, the filling material 28 is inserted into the cavity 26 until the filling material 28 is substantially flush with the exposed surface 14. In other embodiments of the present invention, the filling material 28 may be substantially above or below the exposed surface 14.

The drain cover 10 also includes at least one fin 30 connected to the collar 20 and the cup member 24. In the preferred embodiment, the drain cover 10 includes a plurality of fins 30, as is shown in FIGS. 1-3. In one particular embodiment, and as depicted in FIGS. 1-3, the fins 30 are positioned perpendicular to both the collar 20 and the cup member 24 in a spoke-like configuration. In other embodiments of the present invention, the fins 30 are arranged in a non-perpendicular relation with the collar 20 and/or the cup member 24.

When the drain cover 10 is constructed, the collar 20 defines an area within the fabricated layer 12 that is larger than the area of the cup member 24. In this regard, a drainage area is created between the collar 20 and the cup member 24. The drainage area is the area through which liquid may pass into the drainage system. The size of the drainage area may increase/decrease by varying the size of the cup member 24 relative to the collar 20. It is contemplated that the drainage area may be configured to block particles that would damage/clog the drainage system because of their size, such as stones, pebbles or other debris.

According to various embodiments, the cup member 24 and collar 20 may be configured in a number of different ways. As depicted in FIGS. 1-3, the cup member 24 and the collar 20 may be substantially circular. In other embodiments, the cup member 24 and/or collar 20 may be configured in a number of different shapes, including, but not limited to a quadrangular, oval, triangle, or polygon. In one particular embodiment, the cup member 24 and collar 20 may be arranged such that the cup member 24 is concentrically aligned with the collar 20, as shown in FIGS. 1-3.

As was mentioned above, one of the primary goals of the present invention is to provide a more aesthetically pleasing drain cover 10. As such, the aesthetic quality of the drain cover 10 may be enhanced by matching the color of the frame member 16, collar 20, cup member 24 and fin(s) 30 with that of the fabricated layer 12. Although it is preferred that the drain cover 10 components match the color of the fabricated layer 12, it is not required.

According to aspects of the present invention, there is also provided a method of constructing a drain cover 10 within a fabricated layer 12 having an exposed surface 14. It is understood that the drain cover 10 may be formed within a fabricated layer 12 as the fabricated layer 12 is constructed. In addition, the drain cover 10 may be retrofitted into an existing fabricated layer 12. When the drain cover 10 is installed upon initial construction of the fabricated layer 12 is constructed, the method includes the step of providing a drain cover 10, as described above. The drain cover 10 is positioned such that the fabricated layer 12 is constructable around the drain cover 10. The fabricated layer 12 is subsequently constructed around the drain cover 10. The fabricated layer 12 is preferably constructed such that the upper surface 32 of the collar 20 is substantially flush with the exposed surface 14 of the fabricated layer 12.

In another embodiment of the invention, the method includes the step of inserting filling material 28 into the cavity 26 of the cup member 24. The filling material 28 may be leveled such that the material 28 will be disposed in a substantially level and flush position within the fabricated layer 12.

Although the above described method describes the construction of a drain cover 10 for a drain upon initial construction of the fabricated layer 12, many fabricated layers 12 exist with covers that may not be as aesthetically pleasing and as safe as the drain cover 10 of the present invention. Therefore, the drain cover 10 may also be retro-fit to replace many of the existing covers located within existing fabricated layers 12. In this regard, it is understood that most existing covers are comprised of a frame member and a lid. In order to replace an existing cover with the drain cover 10 of the present invention, the frame and lid of the existing cover are removed from the fabricated layer 12. Once removed, the drain cover 10 of the present invention may be constructed. The frame member 16 of present invention is placed within the drain opening. As was mentioned above, the collar 20 may be detachably connected to the frame member 16, or permanently connected thereto. If the collar 20 is detachably connected to the frame member 16, then the collar 20 is connected to the frame member 16 after the frame member 16 is placed within the drain opening in the fabricated layer 12. After the collar 20 is connected to the frame member 16, the filling material 28 may be inserted into the cavity 26. If the collar 20 is permanently connected to the frame member 16, the filling material 28 may be placed within the cavity 26 after the frame member 16 has been positioned within the drain opening in the fabricated layer 12. The filling material 28 may be leveled such that it is flush with the exposed surface 14 of the fabricated layer 12.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A drain cover for a drain disposed within a fabricated layer having an exposed surface, wherein the drain includes a frame member extending through the fabricated layer, the frame member having a top surface, the drain cover comprising:

a collar having a lower surface, wherein the lower surface is placed adjacent to the top surface of the frame member;

a cup member having a cavity operative to receive a filling material; and at least one fin connected to the collar and the cup member;

wherein the collar defines an area within the exposed surface that is larger than the area of the cup member.

2. The drain cover of claim 1, wherein the cup member is concentrically disposed in relation to the collar.

3. The drain cover of claim 1, further comprising filling material placed within the cup member cavity.

4. The drain cover of claim 3, wherein the fabricated layer is comprised of the filling material.

5. The drain cover of claim 3, wherein the filling material is castable.

6. The drain cover of claim 1, wherein the collar includes a substantially circular perimeter.

7. A drain cover for a drain disposed within a fabricated layer having an exposed surface, the drain cover comprising:

a frame member extending through the fabricated layer, the frame member having a top surface;

a collar having a lower surface, wherein the lower surface is placed adjacent to the top surface of the frame member;

a cup member having a cavity operative to receive a filling material, the cup member being concentrically disposed in relation the collar; and at least one fin connected to the frame and the cup member;

wherein the frame defines an area within the exposed surface that is larger than the cross-sectional area of the cup member.

8. The drain cover of claim 7, further comprising filling material placed within the cup member cavity.

9. The drain cover of claim 8, wherein the fabricated layer is comprised of the filling material.

10. The drain cover of claim 8, wherein the filling material is castable.

11. The drain cover of claim 7, wherein the collar includes a substantially circular perimeter.

12. A method of constructing a drain cover for a drain disposed within a fabricated layer having an exposed surface, wherein the drain includes a frame member extending through the fabricated layer, the frame member having a top surface, the method comprising:

(a) providing a drain cover comprising:

a collar having a lower surface and an upper surface, wherein the lower surface is placed adjacent to the top surface of the frame member;

a cup member having a cavity operative to receive a filling material; and at least one fin connected to the frame and the cup member;

wherein the collar defines an area within the exposed surface that is larger than the area of the cup member;

(b) positioning the drain cover such that the fabricated layer is constructable around the drain cover; and (c) constructing the fabricated layer around the drain cover such that the top surface of the collar is substantially flush with the exposed surface.

13. The method of claim 12, further comprising the step of inserting the filling material within the cavity of the cup member.

14. The method of claim 13, wherein the fabricated layer and the filling material are comprised of the same material.

15. The method of claim 13, further comprising the step of leveling the filling material within the cavity of the cup member such that the filling material is disposed in a substantially level and flush position within the fabricated layer.

16. The method of claim 12, wherein the cup member is concentrically disposed in relation to the collar.

17. The method of claim 12, wherein the perimeter of the collar is substantially circular.

* * * * *